US006462634B2

(12) United States Patent
Latouche et al.

(10) Patent No.: US 6,462,634 B2
(45) Date of Patent: Oct. 8, 2002

(54) RESONATOR, IN PARTICULAR FOR A MICROWAVE FILTER, AND A FILTER INCLUDING IT

(75) Inventors: Yannick Latouche, Toulouse; Serge Vigneron, Auterive, both of (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/754,342

(22) Filed: Jan. 5, 2001

(65) Prior Publication Data

US 2001/0007439 A1 Jul. 12, 2001

(30) Foreign Application Priority Data

Jan. 12, 2000 (FR) ..... 00 00312

(51) Int. Cl.[7] ..... H01P 1/207; H01P 7/06
(52) U.S. Cl. ..... 333/202; 333/219.1; 333/208
(58) Field of Search ..... 333/202, 212, 333/219.1, 208, 209

(56) References Cited

U.S. PATENT DOCUMENTS

| | | | | |
|---|---|---|---|---|
| 5,083,102 A | | 1/1992 | Zaki | 333/212 |
| 5,880,650 A | * | 3/1999 | Latouche et al. | 333/202 |
| 6,211,752 B1 | * | 4/2001 | Gendraud et al. | 333/208 |

FOREIGN PATENT DOCUMENTS

EP 0 742 603 A1 11/1996

OTHER PUBLICATIONS

Maggiore et al., Low–Loss Microwave Cavity Using Layered–Dielectric Materials, 12/93, American Institute of Physics, pp. 1451–1453.*

Gendraud, S. et al., "Design and Realization of a Four Pole Elliptic Microwave Filter Using Low Dielectric Loaded Cavities" IEEE MTT–S International Microwave Symposium Digest, US, New York, NY, IEEE, Jun. 8, 1997, pp. 1091–1094, XP000767684.

Madrangeas, V. et al.: "A New Finite Element Method Formulation Applied to D.R. Microwave Filter Design" MTT–S International Microwave Symposium Digest, US, New York, NY, IEEE, vol.–, May 8, 1990, pp. 415–418, XP000143919.

* cited by examiner

*Primary Examiner*—Benny Lee
*Assistant Examiner*—Stephen E. Jones
(74) *Attorney, Agent, or Firm*—Sughrue Mion, PLLC

(57) ABSTRACT

A microwave resonator, in particular for a filter, comprising a resonant cavity having positioned therein a plane resonator element, frequency tuning means, and intermode coupling means, the resonator element being made of a dielectric material that is at least approximately in the shape of a parallelogram and being disposed transversely in the cavity in such a manner that the vertices of the parallelogram are short-circuited to one another by the conductive inner wall of said cavity. The resonator has at least one other plane resonator element made of dielectric material in a shape that is at least approximately that of a parallelogram, the resonator elements being placed close together, mutually parallel, and extending transversely to a central axis of the cavity. The frequency tuning means and the intermode coupling means are positioned between the parallel resonator elements.

4 Claims, 2 Drawing Sheets

RESONATOR, IN PARTICULAR FOR A MICROWAVE FILTER, AND A FILTER INCLUDING IT

The invention relates to a microwave filter of the resonant cavity type having a conductive wall in which a resonant element of dielectric material is positioned. The invention also relates to a microwave filter including, more particularly said resonator.

BACKGROUND OF THE INVENTION

As is known, and in particular as is stated in the preamble of French patent 2 734 084, such microwave resonators have the characteristic of being excitable only over a narrow frequency band extending about a resonant frequency. They are conventionally implemented to make microwave filters organized around one or more such resonators connected in series. As mentioned in that patent 2 734 084, previous microwave filters are of a design that makes them difficult to produce. Furthermore, heat exchange between the resonator elements and the cavities in which said elements are placed turns out to be insufficient, particularly due to the presence of members made of thermally insulating material for holding the resonator elements in position. Various resonator elements are thus proposed in the above-mentioned patent in order to resolve the problems mentioned above. One of the variants described provides for implementing a resonator element that is thin and flat, and that is positioned in a resonant cavity having a conductive wall. The element is made of a dielectric material that is at least approximately in the form of a parallelogram, and it is dimensioned and mounted in such a manner that the vertices of the parallelogram are short-circuited to one another by the conductive wall, either conductively, or else only for microwaves. Nevertheless, the resonator obtained in that variant has the drawbacks of not recovering enough of the energy which is supplied thereto and of being relatively difficult to adjust.

OBJECTS AND SUMMARY OF THE INVENTION

The present invention thus provides a microwave resonator, in particular for a filter, the resonator comprising a resonant cavity with a conductive wall in which there are positioned a plane resonator element, frequency tuning means, and intermode coupling means, the plane resonator element being made of a dielectric material in a shape that is at least approximately a parallelogram and that is disposed transversely in the cavity in such a manner that the vertices of the parallelogram that it forms are short-circuited to one another by the conductive wall, at least at microwave frequencies.

According to a characteristic of the invention, said resonator has at least one other plane resonator element, made of a dielectric material in a shape that is at least approximately a parallelogram, the resonator elements being close together, mutually parallel, and extending transversely to a central axis of the cavity, together with frequency tuning means and intermode coupling means positioned between the parallel resonator elements. This causes the resonator to have a broader working band.

The invention also provides a microwave filter which comprises at least one microwave resonator as defined above, associated with means for injecting microwave energy to the inlet of the filter to excite the resonator(s), and means for extracting resonant energy from the outlet of the filter, together with means for providing coupling between the resonators in series when the filter has more than one resonator.

BRIEF DESCRIPTION OF THE DRAWINGS

The invention, its characteristics, and its advantages are described in greater detail below with reference to the following figures.

MORE DETAILED DESCRIPTION

Figure 1:
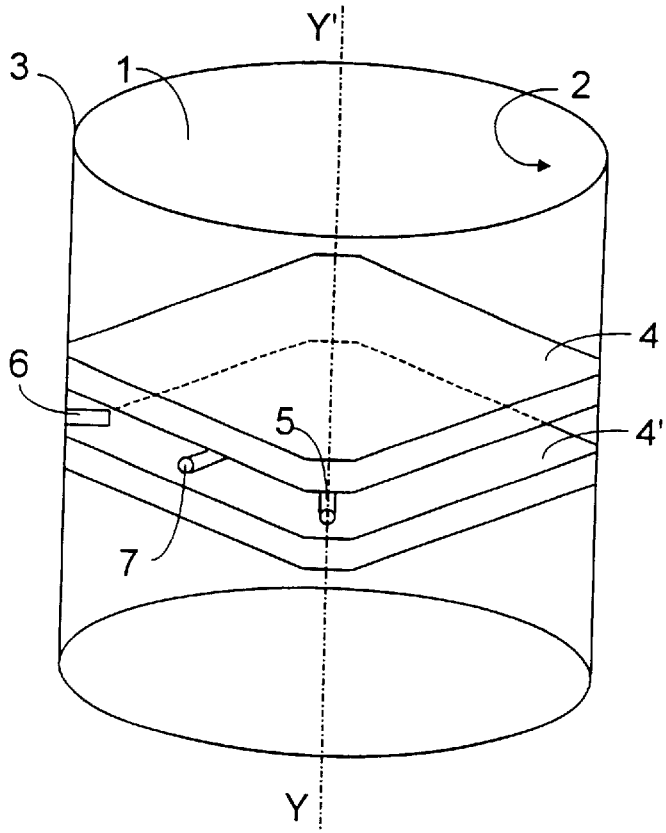
FIG. 1 is a diagram of a microwave resonator of the invention.

The microwave resonator shown in FIG. 1 has a resonant cavity 1 whose wall 2 is electrically conductive. In conventional manner, the section of the cavity can be a quadrangle; in the preferred embodiment as shown, the cross-section of the cavity is circular and it extends internally along the length of a circularly cylindrical tube element 3 whose ends are closed. By way of example, the tube element is made out of a metal that is a good conductor.

Plane resonator elements such as 4 and 4' are mounted in the middle zone of the cavity where they are placed in parallel, transversely to the central longitudinal axis YY' of the cavity and close to each other. These resonator elements are made of a dielectric material which preferably possesses a dielectric constant E that is large, a Q factor that is large, and a small coefficient of variation in resonant frequency as a function of temperature.

In a preferred embodiment, the resonator is excited in TE 101 fundamental mode, thereby making it possible to obtain the lowest possible working frequencies for a resonator of given dimensions.

Figure 2:
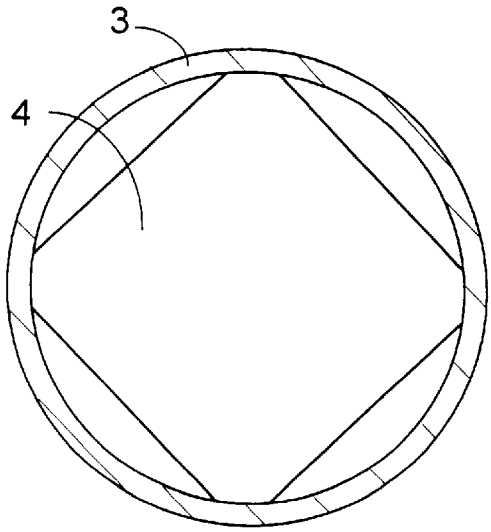
FIG. 2 is a section view of the FIG. 1 resonator.

The resonator elements are essentially plane, even if they might contain iris type openings for coupling purposes and local variations in thickness, in particular extra thicknesses in thermal link zones. As already proposed in French patent 2 734 084, they are preferably and at least approximately parallelogram-shaped. In the embodiment shown, the resonator elements are square in shape. The vertices of the parallelograms (or squares) are blunted so as to match the shape of the inside wall of the cavity in which they are positioned and with which they provide substantially all of the heat exchange needed in operation by the resonator element of which they form a part. In the example shown, the vertices of the squares constituted by the resonator elements 4 and 4' are thus rounded so as to be complementary in shape to the inside wall 2 of the circular cylinder defining the cavity 1. The link between the vertices and the wall 2 can take place by direct conduction if the resonator elements are fixed directly so as to press against said wall, as shown in FIG. 2. It can also take place merely at microwave frequencies if each vertex bears against the wall via a thin intermediate fixing element in a conventional manner that is not described herein. By way of example, each intermediate element can be resilient so as to hold each resonator element in position while accommodating dimensional variations due to temperature variations. Such a mount can be designed in conventional manner to allow microwave coupling to take place between the resonator elements and the inside wall of a resonant cavity at the operating frequency.

The resonator elements received inside a cavity are preferably in a position close to each other in the middle zone of the cavity, and frequency tuning means together with coupling means are provided in the gap left to receive them between the parallel resonators, as can be seen in FIG. 1.

These various means are conventional and are represented herein by a first tuning adjustment screw 5 for a first mode. This first screw extends perpendicularly to the axis YY' of the cavity, passing through the wall thereof, so as to project into the cavity to a greater or lesser extent. A second tuning adjustment screw 6 for a second mode is mounted in analogous manner so as to be coplanar on an axis that is perpendicular to the axis of the screw 5. A third tuning screw 7 serves to vary energy coupling between the excitation modes of the resonator and it is mounted in the same plane as the other two screws, but at 45° relative to their axes.

As mentioned, putting resonator elements such as 4 and 4' in parallel makes it possible to broaden the working band of the microwave resonator that includes them, by enabling better mode excitation. Gain of about 3.4 can be obtained with a microwave resonator having a circularly cylindrical cavity containing two plane resonator elements that are square in shape with their vertices being short-circuited by the inside wall of the cavity.

With this type of resonator, a high Q factor Q0 and good isolation can be obtained in TE 101 fundamental mode.

A particular advantage of using two resonator elements in parallel is that a resonator containing these two elements can provide a result corresponding to that which would otherwise be obtained using a single resonator element that is thicker. This is particularly advantageous when such a thicker element is not available. The use of resonator elements disposed in parallel and of different thicknesses also makes it possible to obtain a range of microwave resonators by combining resonator elements that have different respective thicknesses and consequently that have different resonant frequencies. such a range can be obtained in particular by combining a resonator element of given thickness with resonator elements each having a different thickness, e.g. increasing thickness, in combinations each comprising two resonator elements. Provision could also be made to combine more than two resonator elements, should that be necessary.

Figure 3:
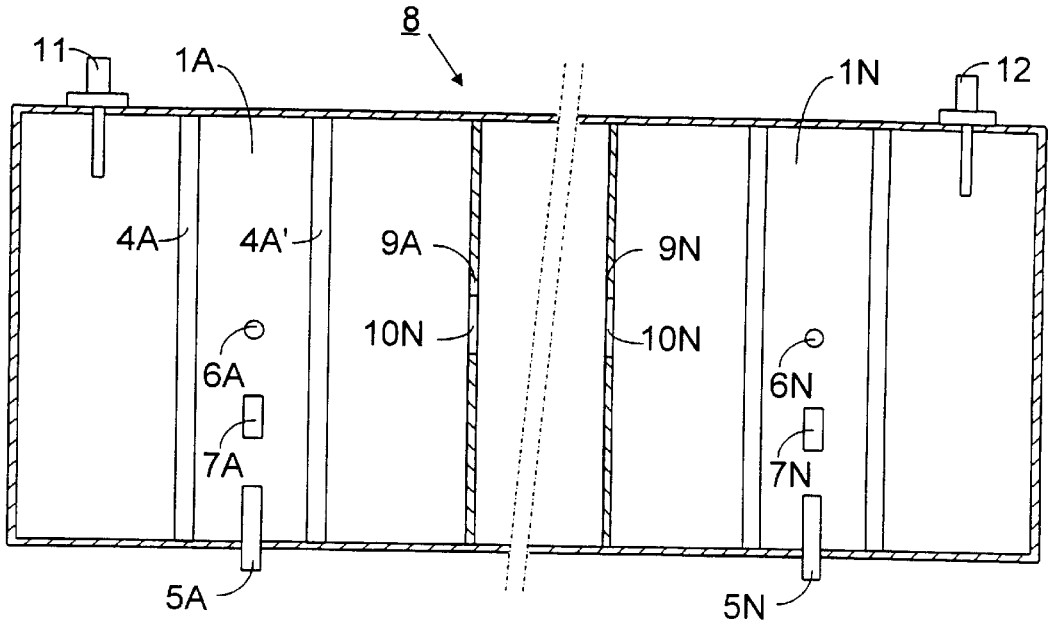
FIG. 3 is a section view of a microwave filter having a plurality of resonators of the invention.

FIG. 3 is a section through a microwave filter 8 having a plurality of microwave resonators of the invention such as 1A and 1N. These resonators are in alignment on a common axis which constitutes the central longitudinal axis of the filter. Transverse walls such as 9A and 9N are placed in the tubular elements containing the set of microwave resonators, so as to split the cavities formed by the resonators taken in pairs. These partitions are arranged in such a manner as to enable coupling to take place between the resonator cavities they separate. This coupling can be obtained by any suitable means, for example by an opening such as 10A or 10N of the iris or slot type, assumed in this case to be in the middle of the partition. The partitions and the tubular element are made of materials of the kind commonly used in this field.

In conventional manner, the microwave filter 8 has an inlet cavity which is constituted in this case by the resonant cavity of a resonator of the invention, here the cavity 1A. This has external coupling means enabling it to be connected to a source of microwave energy supplying the signal to be processed. These coupling means are situated upstream from the resonator elements 4A, 4A' contained in the cavity and, for example, they are constituted by a probe 11. In a preferred embodiment, the inlet cavity is excited in a TE mode, such as TE 101, thus making it possible to obtain a resonant frequency that is relatively low for given dimensions, and also a working band of width that is improved relative to that of an equivalent resonator having a single resonator element, as already mentioned above.

One or more microwave resonators can be connected in series after the inlet resonator, either in the same tubular element as shown, or optionally in a set of tubular elements that are disposed adjacent to one another in alignment. Each resonator of the invention comprises two resonator elements in a cavity, e.g. elements 4A and 4A' for the resonator whose cavity is 1A, together with tuning and coupling means such as those referenced 5A, 6A, 7A or 5N, 6N, 7N for the resonators whose cavities are 1A and 1N.

The resonator whose cavity is referenced 1N and which is the last in the sequence of resonators in the filter 8 includes means enabling resonant microwave energy to be extracted from the filter after it has been filtered. These extraction means are constituted in this case by a probe 12.

Figure 4:
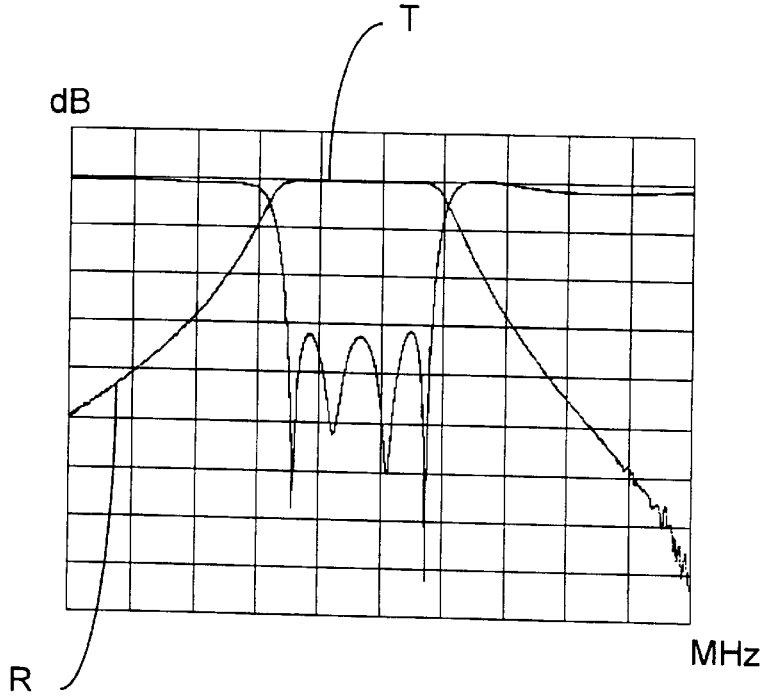
FIG. 4 is a plot showing the transmission response and the reflection losses of an embodiment of a filter of the invention.

A plot is given by way of non-limiting example in FIG. 4 to show the effectiveness of a filter of the invention. The units for the ordinate of this plot are 10 dB per square for the transmission curve and 5 dB per square for the loss curve, and 20 MHz per square for the abscissa. This filter has four poles in 47 MHz of working bandwidth and it is assumed to be centered on a frequency of 1655 MHz. The curve T showing filter transmission as a function of frequency shows that its transmission window is about 47 MHz at maximum transmission and about 94 MHz at −25 dB. The curve R shows the corresponding appearance of reflection losses as a function of frequency.

The choice of thicknesses for the resonator elements and the flexibility of combination obtained by associating elements, in particular in pairs, makes it possible to provide and operate filters of the invention over a range of frequencies that is larger than that which was known in the past.

What is claimed is:

1. A microwave resonator for a filter, comprising a resonant cavity having a conductive wall, in which there are positioned a planar resonator element, frequency tuning means, and intermode coupling means, the planar resonator element made of a dielectric material in a shape that is at least approximately a parallelogram being disposed transversely in the cavity such that the vertices of the parallelogram are short-circuited to one another by the wall, at least at microwave frequencies, said resonator having at least one other planar resonator element, made of a dielectric material in a shape that is at least approximately a parallelogram, the resonator elements being close together, mutually parallel, and extending transversely to a central axis of the cavity, and wherein the frequency tuning means and the intermode coupling means are positioned between the parallel resonator elements.

2. The microwave resonator according to claim 1, having at least two planar and parallel resonators of different thicknesses.

3. The microwave resonator according to claim 1, in which the cavity is a circular cylinder and contains resonator elements that are thin and planar, each being made of a dielectric material in a shape that is at least approximately square.

4. The microwave resonator of claim 1, having said microwave resonator associated with a microwave energy injection means placed upstream from another microwave resonator and a resonant energy extraction means placed downstream therefrom, together with the coupling means are between said microwave resonators coupled in series when the filter has more than one resonator.

* * * * *